US006789451B1

(12) United States Patent
Wu

(10) Patent No.: US 6,789,451 B1
(45) Date of Patent: Sep. 14, 2004

(54) SECURING APPARATUS OF ADJUSTABLE WRENCH TO PREVENT MOVABLE JAW FROM TREMBLING

(76) Inventor: Arthur Wu, No. 22, Alley 28, Lane 360, Chung Shan Rd., She Kou Village, Shen Kang Hsiang, Taichung Hsien (TW), 429

( * ) Notice: Subject to any disclaimer, the term of this patent is extended or adjusted under 35 U.S.C. 154(b) by 0 days.

(21) Appl. No.: 10/385,484

(22) Filed: Mar. 12, 2003

(51) Int. Cl.[7] ..... B25B 13/16

(52) U.S. Cl. ..... 81/157; 81/133; 81/134; 81/138; 81/143

(58) Field of Search ..... 81/133, 134, 138, 81/143, 157, 165, 170

(56) References Cited

U.S. PATENT DOCUMENTS 4,106,372 A * 8/1978 Miller ..... 81/143
4,454,791 A * 6/1984 Seward, III ..... 81/133
6,418,819 B1 * 7/2002 Kuo ..... 81/165
6,679,139 B2 * 1/2004 Brenizer ..... 81/165

* cited by examiner

*Primary Examiner*—Joseph J. Hail, III
*Assistant Examiner*—Alvin J. Grant
(74) *Attorney, Agent, or Firm*—Bacon & Thomas, PLLC

(57) ABSTRACT

An adjustable wrench has a handle having a fixed jaw, a movable jaw, an adjusting worm and an adjusting device. The adjusting worm is received in an opening of the handle and engages with the movable jaw to drive the movable jaw to move along the guiding slot. The adjusting device has an axle portion received in a through hole of the adjusting worm and a wheel portion positioned beside the adjusting worm. The adjusting device is pivoted on the handle via a shaft to be turned along a rotation axle and the adjusting worm is turned along a rotation axle. The rotation axles of the adjusting device and the adjusting worm deviate from each other whereby the adjusting device is turned to move the adjusting worm toward or away from the movable jaw.

9 Claims, 8 Drawing Sheets

SECURING APPARATUS OF ADJUSTABLE WRENCH TO PREVENT MOVABLE JAW FROM TREMBLING

BACKGROUND OF THE INVENTION

1. Field of the Invention.

The present invention relates generally to a hand tool, and more particularly to an adjustable wrench, which can hold a movable jaw when it is moved to a predetermined position.

2. Description of the Related Art

A conventional adjustable wrench comprised a handle having a fixed jaw at an end thereof, a movable jaw slidably provided on the handle having a rack and an adjusting worm pivoted on the handle and engaged with the rack of the movable jaw such that the movable jaw can be moved by turning the adjusting worm.

There must be a clearance of teeth left between the rack of the movable jaw and a helical tooth of the adjusting worm so that the adjusting worm can smoothly drive the movable jaw. But the movable jaw can not stand in a fixed position because of the clearance of teeth since the distance between the movable jaw and the fixed jaw can not be kept constant even though the adjusting worm has not been turned.

FIG. 8 shows a conventional apparatus for an adjustable wrench to secure a movable jaw 78. The adjustable wrench has a hole 74 on a handle 72 and a fastening device 76 provided in the hole 74. The fastening device 76 can be screwed into the hole 74 and press the movable jaw 78 to secure the movable jaw.

FIG. 9 shows a second conventional adjustable wrench having a screw bar 82 driven by a nut 80 to press a movable jaw 84.

FIG. 10 shows a third conventional adjustable wrench having a rectangular slide 86 sliding transversely and against a worm 88 to make the worm 88 can not be turned.

FIG. 11 shows a fourth conventional adjustable wrench having a movable plate 90 with teeth 90 thereon engaged with clutch teeth 96 at a movable jaw 94.

FIG. 12 shows a fifth conventional adjustable wrench having a locking disk 98 to secure an adjusting worm 100.

FIG. 13 shows a sixth conventional adjustable wrench having a control mechanism 102 that moves a worm 104 against a movable jaw 106.

SUMMARY OF THE INVENTION

The primary objective of the present invention is to provide an adjustable wrench, which has an apparatus to secure the movable jaw to prevent the movable jaw from trembling when it has moved to any position.

According to the objective of the present invention, an adjustable wrench comprises a handle having a head portion and shank, wherein the head portion has a fixed jaw, a transverse guiding slot and an opening communicated with the guiding slot, a movable jaw having a guiding portion and a rack on the guiding portion, wherein the movable jaw receives the guiding portion in the guiding slot of the handle to be moved toward or away from the fixed jaw, an adjusting worm having a through hole at a center thereof and a helical tooth an outer surface thereof, wherein the adjusting worm is received in the opening and engages the helical tooth with the rack of the movable jaw whereby the adjusting worm is turned to drive the movable jaw to move along the guiding slot, and an adjusting device having at least a part thereof received in the through hole of the adjusting worm whereby the adjusting worm is turned freely relative to the adjusting device. The adjusting device is pivoted on the handle to be turned along a rotation axle and the adjusting worm is turned along a rotation axle and the rotation axle of the adjusting device deviates from the rotation axle of the adjusting worm whereby the adjusting device is turned to move the adjusting worm toward or away from the movable jaw.

DETAILED DESCRIPTION OF THE INVENTION

Figure 1:
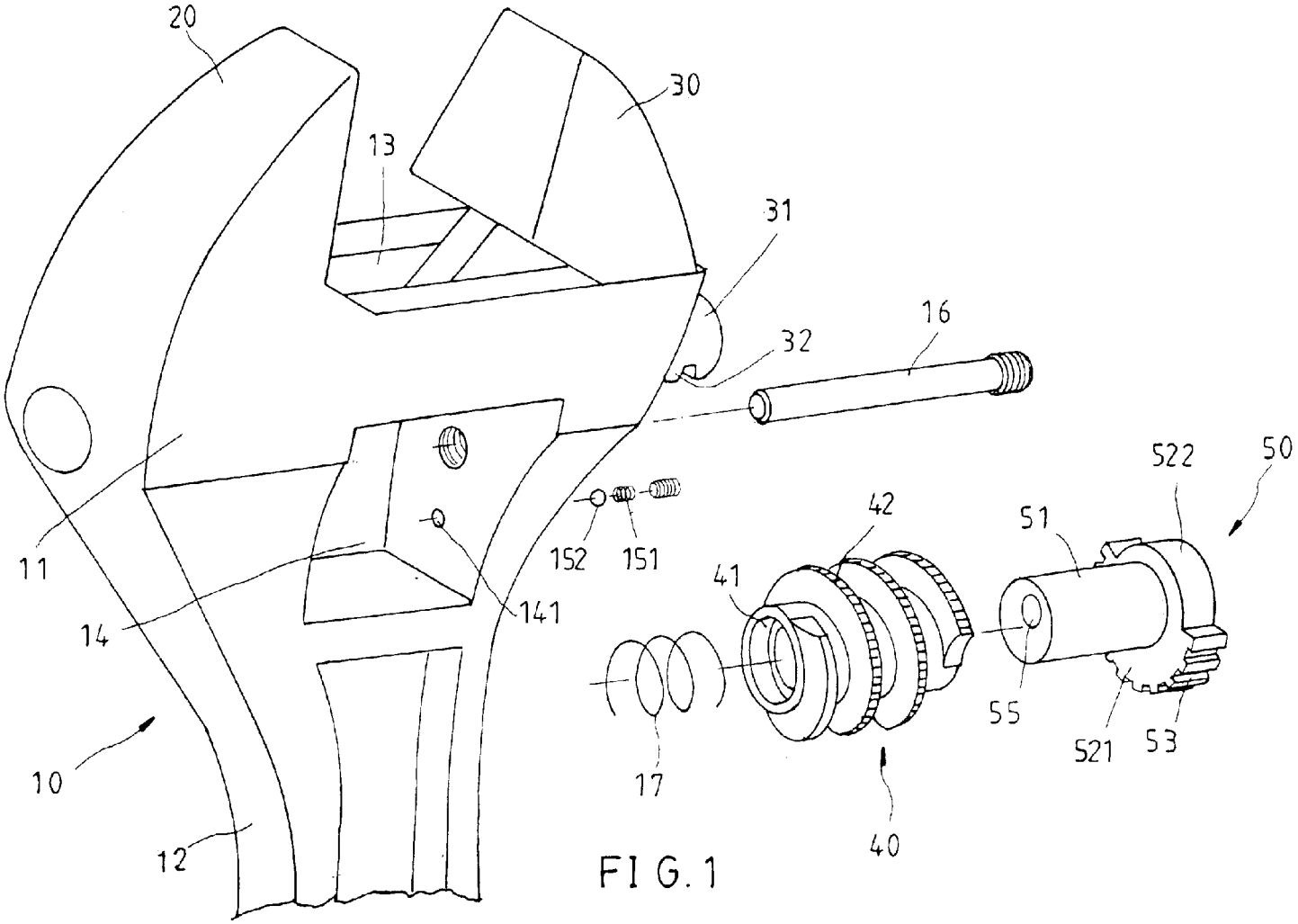
FIG. 1 is an exploded view of a preferred embodiment of the present invention.
Figure 2:
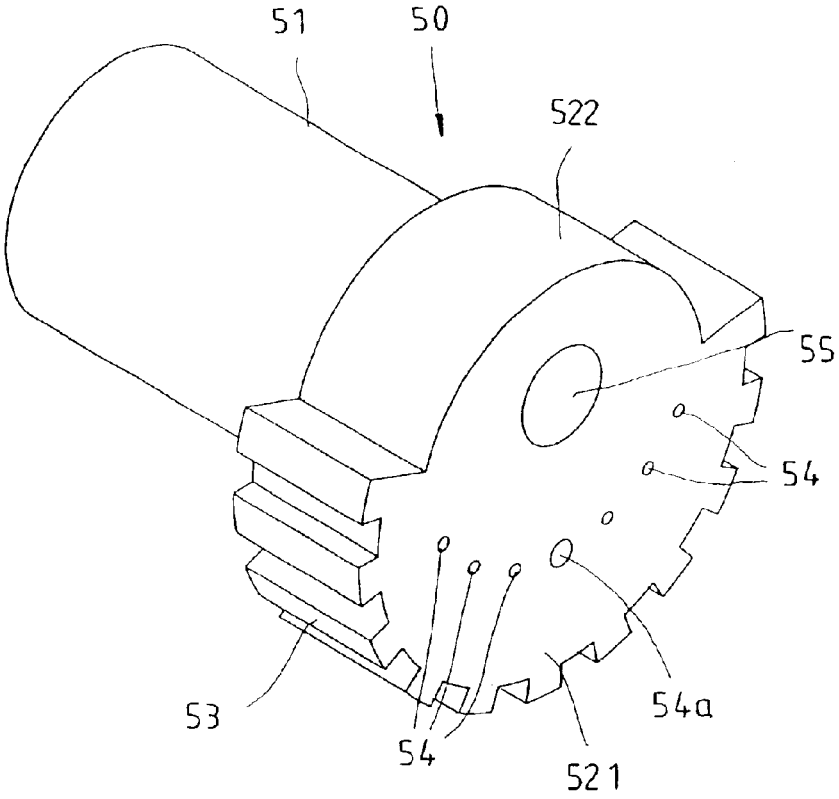
FIG. 2 is a perspective view of the adjusting device of the preferred embodiment of the present invention.
Figure 3:
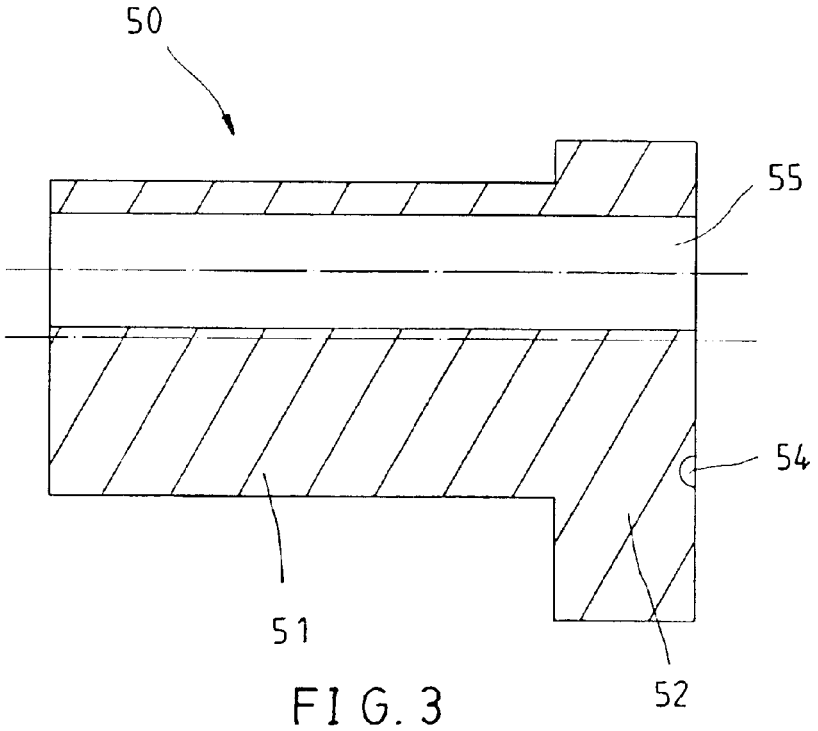
FIG. 3 is a front view of FIG. 2.

Please refer to FIGS: from FIG. 1 to FIG. 4, an adjustable wrench of the preferred embodiment of the present invention mainly comprises a handle 10 having a fixed jaw 20 at an end thereof, a movable jaw 30, an adjusting jaw 40, and an adjusting device 50.

The handle 10 has a head portion 11 and a shank 12. The fixed jaw 20 is located at a distal end of the head portion 11. The head 11 is provided with a transverse guiding slot 13 and an opening 14 under the guiding slot 13 and communicated with it. The shank 12 has a gap 15 communicated with the opening 14. The head portion 11 further has a slot 141 on a sidewall of the opening 14 in which a spring 151 and a ball 152 are installed in sequence.

The movable jaw 30 has a guiding portion 31 at an end thereof to be received in the guiding slot 13 of the handle 10 such that the movable jaw 30 can move along the guiding slot 13.

The adjusting worm 40 has a through hole 41 at a center and a helical tooth 42 at an outer surface, wherein a central axial line of the through hole is as same as a central axial line of the adjusting worm 41.

The adjusting device 50 includes two round columns. The adjusting device 50 includes an axle portion 51 and a wheel portion 52, wherein a diameter of the axle portion 51 is slightly smaller than a diameter of the through hole 41 of the adjusting worm 40. The wheel portion 52 consists of a larger arch portion 521 and a smaller arch portion 522, wherein a semi-diameter of the larger arch portion 521 is equal to or slightly larger than a semi-diameter of the adjusting worm 40 and a semi-diameter of the smaller arch portion 522 is equal to or slightly smaller than a root semi-diameter of the adjusting worm 40. The larger arch portion 521 has textures 53 at an annular surface thereof and plural of recesses 54 at an end surface thereof. The recesses 54 are arranged as a semi-circle and the central recess 54a has a larger diameter than the rest. The adjusting device 50 has a through hole 55 running the axle portion 51 and the wheel portion 52. A central axial line of the through hole 55 is deviated from a central axial line of the adjusting device 50 in a predetermined distance.

The axle portion 51 of the adjusting device 50 is inserted into the through hole 41 of the adjusting worm 40 for the wheel portion 52 positioned beside an end of the adjusting worm 40. The adjusting worm 40 and the adjusting device 50 are installed in the opening 14 of the handle 10 with a spring 17 against a sidewall of the opening 14 and the adjusting worm 40 and a shaft 16 runs through the through hole 55 of the adjusting device 50 and the spring 17 to pivot the adjusting worm 40 and the adjusting device 50 on the handle 10 for free rotation. The helical tooth 42 of the adjusting worm 40 is engaged with rack 32 of the movable jaw 30. The adjusting worm 40 is turned relative to the axle portion 51 of the adjusting device 50 and the adjusting device 50 is turned relative to the shaft 16, in other words, the adjusting worm 40 has a rotation axle Lw and the adjusting device has a rotation axle La, the rotation axles Lw and La are two parallel lines and deviated in a predetermined distance.

The adjusting worm 40 is turned along the rotation axle Lw to drive the movable jaw due to the engagement of the rack 32 and the helical tooth 42.

The adjusting device 50 is turned while user exerts his/her finger on the wheel portion 52. Under such condition, the adjusting device 50 is turned along the rotation axle La. Because the shaft 16 is not located at the central axle line of the adjusting device 50 so that the adjusting device serves as a cam to the adjusting worm, in other words, the adjusting worm 40 is moved along a diameter orientation while the adjusting device 50 is turned.

Figure 5:
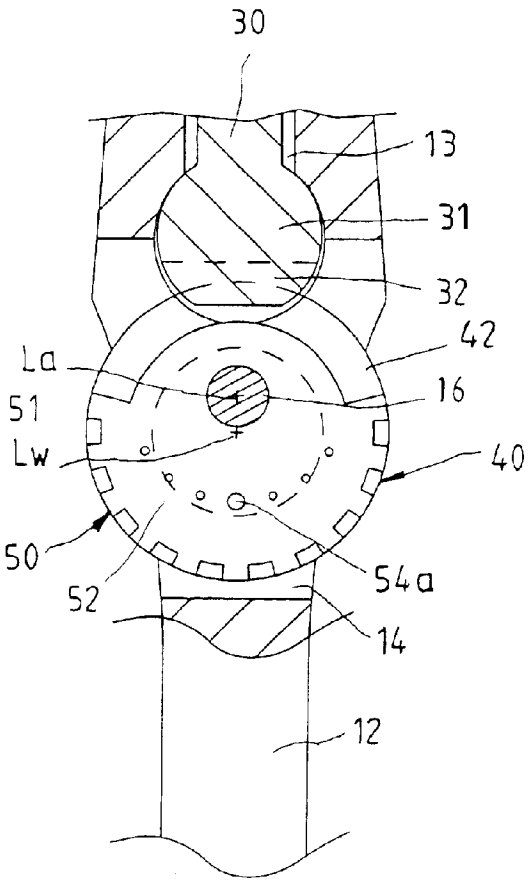
FIG. 5 is a lateral view of FIG. 4.
Figure 4:
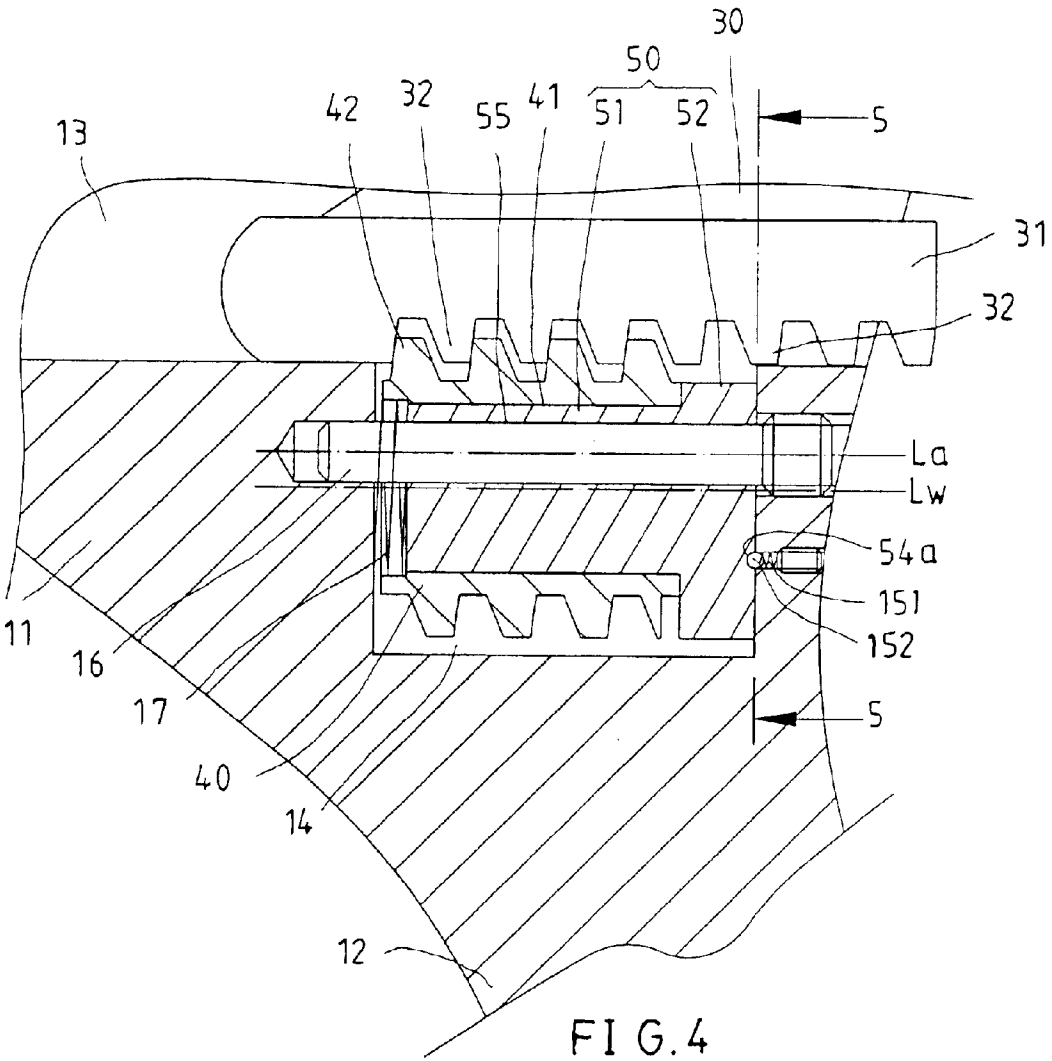
FIG. 4 is a sectional view in part of the preferred embodiment of the present invention, showing the clearance of teeth between the adjusting worm and the rack of the movable jaw kept in normal.

In use, I recommend that the adjusting device 50 is turned to a position at where the ball 152 drops into the larger recess 54a as shown in FIG. 4 and FIG. 5. The clearance between the rack 32 of the movable jaw 30 and the helical tooth 42 of the adjusting worm 40 is kept in normal in such condition so that adjusting worm 40 is turned freely to move the movable jaw 30.

Figure 7:
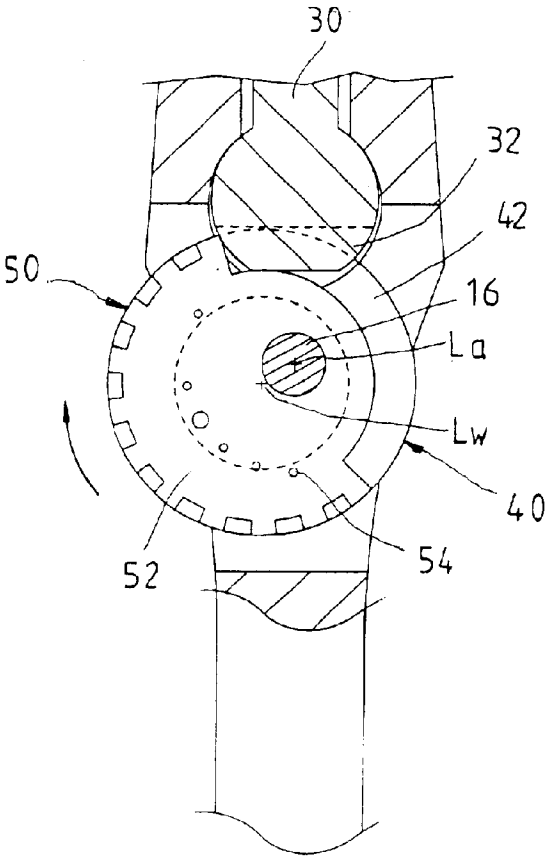
FIG. 7 is a lateral view of FIG. 6.
Figure 6:
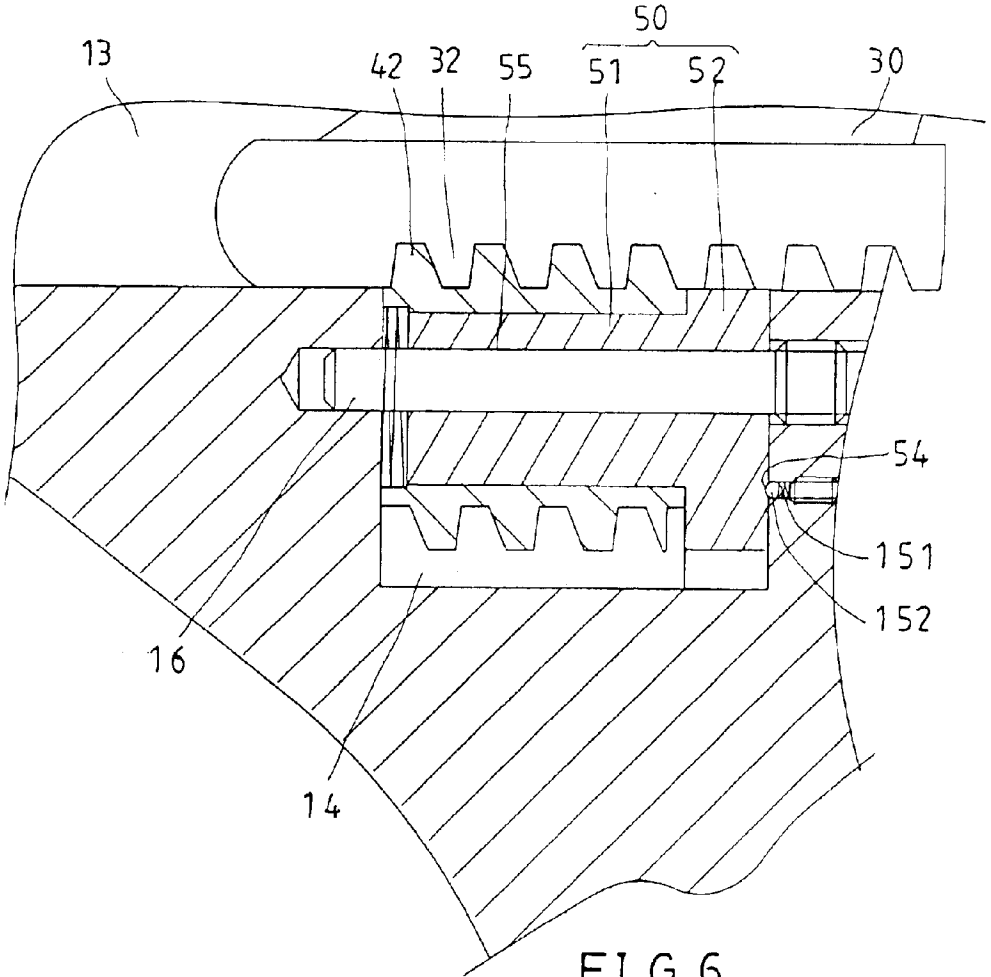
FIG. 6 is a sectional view in part of the preferred embodiment of the present invention, showing the adjusting device being turned so as to move the adjusting worm upwardly to eliminate the clearance of teeth between the adjusting worm and the rack of the movable jaw.
Figure 8:
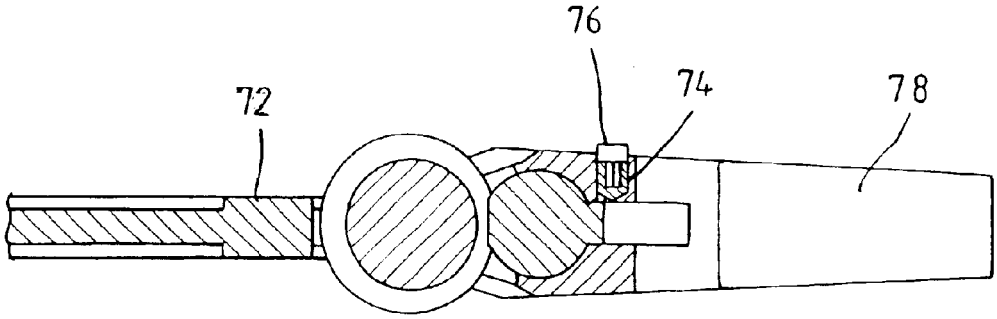
FIG.8 PRIOR ART
Figure 9:
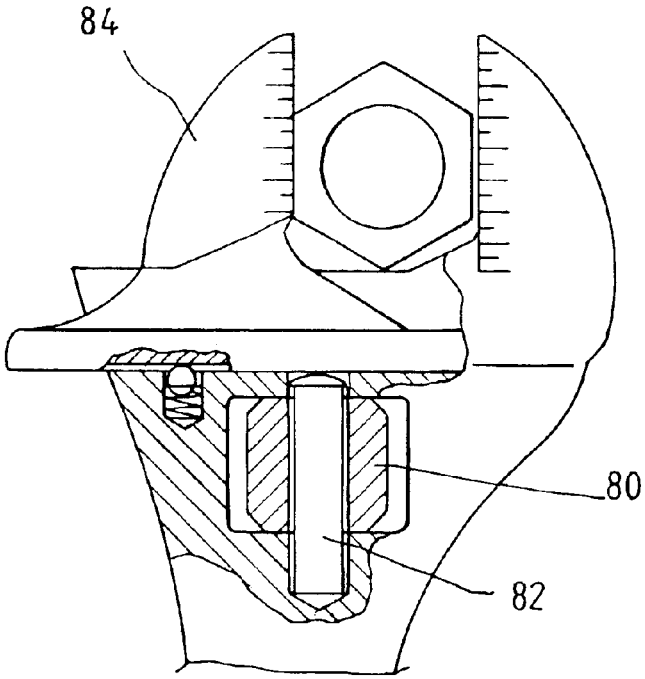
FIG.9 PRIOR ART
Figure 10:
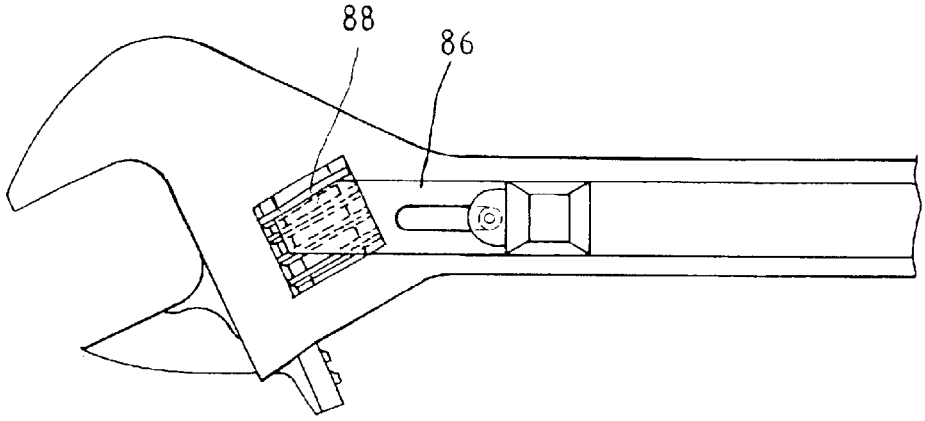
FIG.10 PRIOR ART
Figure 11:
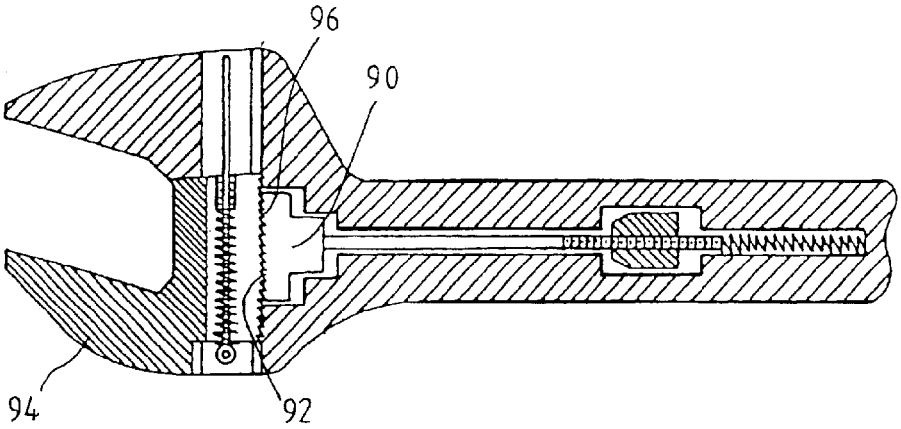
FIG.11 PRIOR ART
Figure 12:
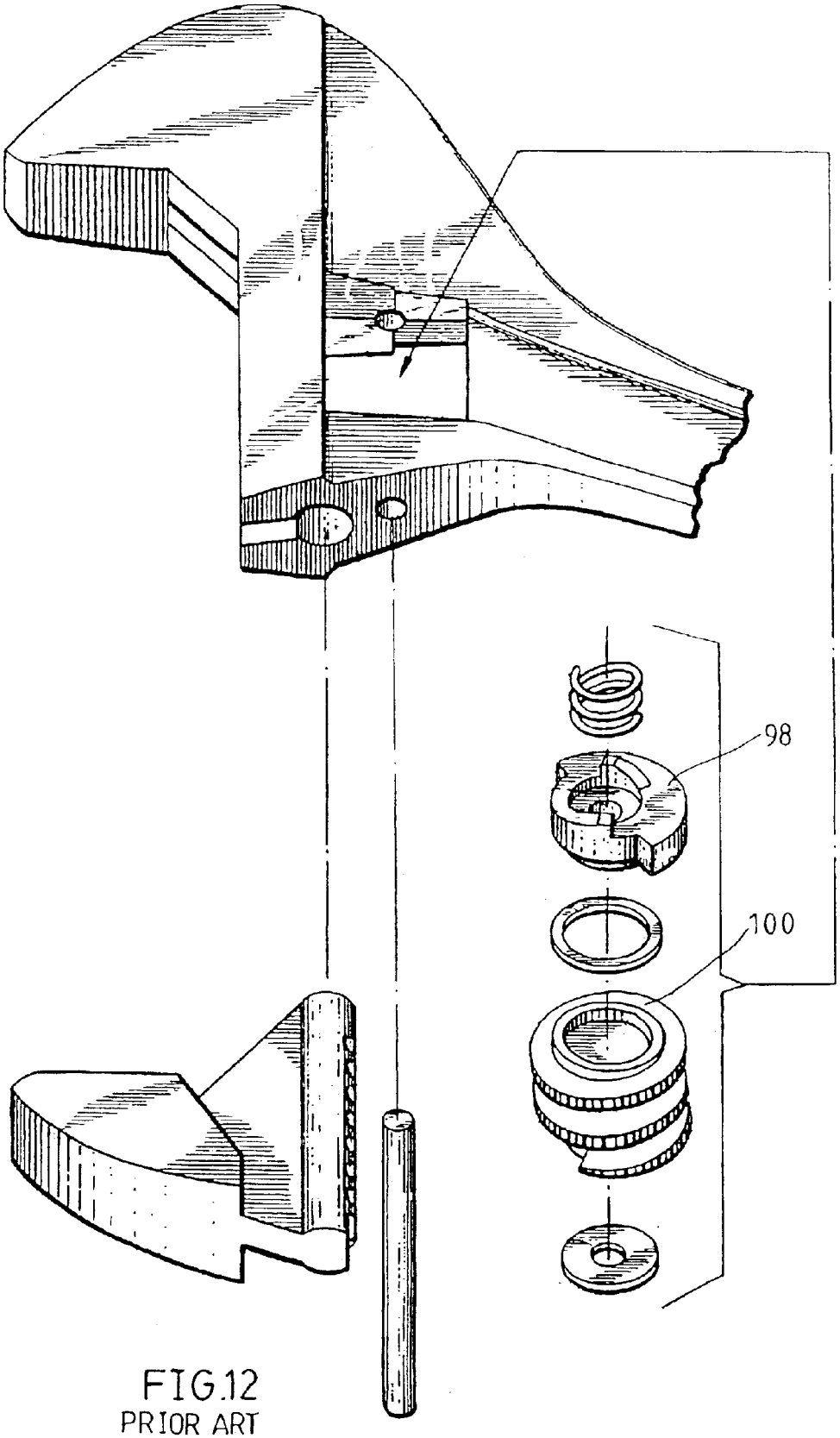
FIG.12 PRIOR ART
Figure 13:
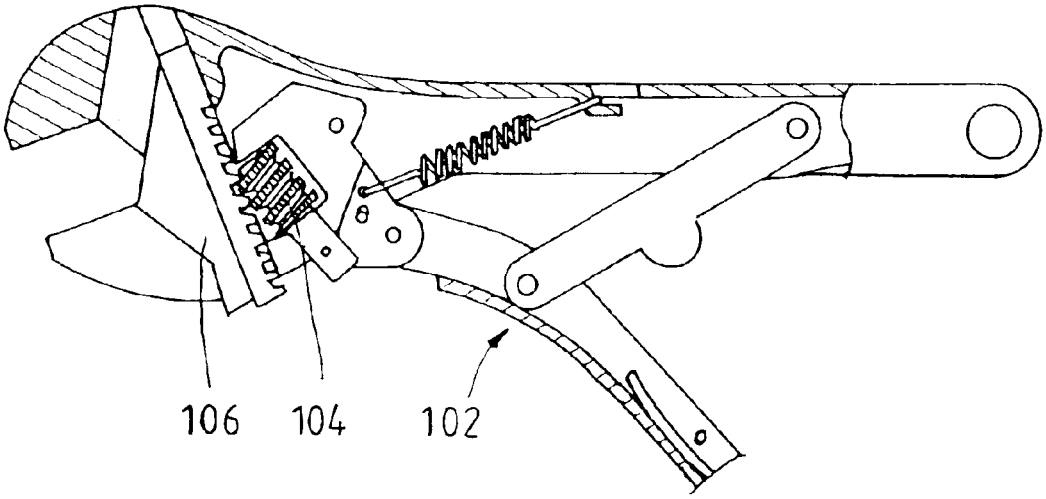
FIG.13 PRIOR ART

While the movable jaw 30 is moved to a suitable position, the adjusting device 50 is turned to move the adjusting worm 40 toward the movable jaw 30 as shown in FIG. 6 and FIG. 7. The clearance between the rack 32 of the movable jaw 30 and the helical tooth 42 of the adjusting worm 40 will be eliminated, until the adjusting device 50 cannot be turned anymore. The movable jaw 30 is pushed and secured by the adjusting worm 40 while the adjusting device 50 forces the adjusting worm 40 to move towards the movable jaw 30, and the movable jaw 30 can not move any further in order to keep a distance between the fixed jaw 20 and the movable jaw 30 constant, so that the adjustable wrench will work like an open-end wrench.

The adjusting device 50 is turned reversely to release the adjusting worm 40 from the movable jaw 30 while the movable jaw 30 needs to move again. I suggest that the adjusting device 50 is turned to the position at where the ball 152 drops into the larger recess 54*a*, there will be a suitable clearance between the rack 32 of the movable jaw 30 and the helical tooth 42 of the adjusting worm 40 for adjusting worm 40 driving the movable jaw 30 to move.

Typically, there only is a distance of about 0.5 mm to 1.8 mm for the adjusting worm 40 moving toward the movable jaw 30. The distance relates to the size of the wrench. The angle of the adjusting device 50 being turned to move the adjusting worm 40 toward the movable jaw 30 relates to a distance between the rotation axles Lw and La.

While the ball 152 drops into the larger recess 54*a*, there is a feedback for user to identify that the adjusting worm 40 has returned the normal position. The ball 152 will drop into one of the recess 54 while the adjusting device 50 is turned to a predetermined angle. There will be a positioning force for the adjusting device 50 to prevent it from being turned by accident.

The largest distance of the adjusting worm 40 moved by the adjusting device 50, in practice, is larger than the clearance between the rack 32 of the moveable jaw 30 and he helical tooth 42 of the adjusting worm 40. The adjusting device 50 only needs to be turned a given angle, the adjusting worm 40 can be move for a sufficient distance to eliminate the clearance. User will get a feedback that he/she cannot turn the adjusting device 50 anymore when the clearance has been eliminated.

What is claimed is:

1. An adjustable wrench, comprising:

a handle having a head portion and shank, wherein the head portion has a fixed jaw, a transverse guiding slot and an opening communicated with the guiding slot;

a movable jaw having a guiding portion and a rack on the guiding portion, wherein the movable jaw receives the guiding portion in the guiding slot of the handle to be moved toward or away from the fixed jaw;

an adjusting worm having a through hole at a center thereof and a helical tooth at an outer surface thereof, wherein the adjusting worm is received in the opening and engages the helical tooth with the rack of the movable jaw whereby the adjusting worm is turned to drive the movable jaw to move along the guiding slot;

an adjusting device having at least a part thereof received in the through hole of the adjusting worm whereby the adjusting worm is turned freely relative to the adjusting device; and wherein the adjusting device is pivoted on the handle to be turned along a rotation axle and the adjusting worm is turned along a rotation axle and the rotation axle of the adjusting device deviates from the rotation axle of the adjusting worm whereby the adjusting device is turned to move the adjusting worm toward or away from the movable jaw.

2. The adjustable wrench as defined in claim 1, wherein the adjusting device has a through hole deviated from a center of the adjusting device and a shaft runs through the through hole to pivot the adjusting device on the handle.

3. The adjustable wrench as defined in claim 1, wherein the adjusting device has an axle portion and a wheel portion wherein the axle portion is inserted into the through hole of the adjusting worm and the wheel portion is positioned beside an end of the adjusting worm.

4. The adjusting wrench as defined in claim 3, the wheel portion of the adjusting device has textures at an annular surface thereof.

5. The adjustable wrench as defined in claim 3, wherein the wheel portion of the adjusting device has a larger arch portion and a smaller arch portion wherein a semi-diameter of the larger arch portion is about equal to or slightly larger than a semi-diameter of the adjusting worm and a semi-diameter of the smaller arch portion is about equal to or slightly smaller than a root semi-diameter of the adjusting worm.

6. The adjustable wrench as defined in claim 5, wherein the wheel portion of the adjusting device has textures at an annular surface of the larger arch portion.

7. The adjustable wrench as defined in claim 1, wherein the adjusting device has a plurality of recesses at an end thereof.

8. The adjustable wrench as defined in claim 7, wherein the handle is provided with a slot at a sidewall of the opening in which a spring and a ball are installed in sequence wherein the ball drops into the recesses respectively while the adjusting device is turned.

9. The adjustable wrench as defined in claim 7 wherein one of the recesses is larger than the rest.

* * * * *